United States Patent [19]

Smith et al.

[11] Patent Number: 4,627,899

[45] Date of Patent: Dec. 9, 1986

[54] ELECTROLYTIC CELL AND METHODS COMBINING ELECTROWINNING AND ELECTROCHEMICAL REACTIONS EMPLOYING A MEMBRANE OR DIAPHRAGM

[75] Inventors: Gerald R. Smith, Columbia; William R. Thompson, Wheaton, both of Md.

[73] Assignee: The United States of America as represented by the Secretary of the Interior, Washington, D.C.

[21] Appl. No.: 702,201

[22] Filed: Feb. 15, 1985

[51] Int. Cl.[4] ..... C25B 1/24; C25C 1/06; C25C 1/10; C25C 1/00

[52] U.S. Cl. ..... 204/95; 204/105 R; 204/105 M; 204/106; 204/112; 204/114; 204/115

[58] Field of Search ..... 204/95, 105 R, 105 M, 204/106-108, 112-115, 118

[56] References Cited

U.S. PATENT DOCUMENTS

| | | | |
|---|---|---|---|
| 3,692,647 | 9/1972 | Chambers et al. | 204/106 |
| 3,891,521 | 6/1975 | Carlin | 204/105 |
| 3,957,504 | 5/1976 | Ho et al. | 204/106 |
| 3,974,049 | 8/1976 | James et al. | 204/106 |
| 4,030,989 | 6/1977 | Atmore | 204/108 |
| 4,169,776 | 10/1979 | Eddleman | 204/118 |
| 4,204,922 | 5/1980 | Fraser et al. | 204/105 |
| 4,234,393 | 11/1980 | Hepworth et al. | 204/105 |
| 4,246,090 | 1/1981 | de Nora et al. | 204/296 |
| 4,268,363 | 5/1981 | Coughlin | 204/106 |
| 4,272,341 | 6/1981 | Lamb | 204/118 |
| 4,421,616 | 12/1983 | Bjone et al. | 204/115 |

FOREIGN PATENT DOCUMENTS

| | | | |
|---|---|---|---|
| 1173669 | 7/1964 | Fed. Rep. of Germany | 204/115 |
| 2943533 | 5/1981 | Fed. Rep. of Germany | 204/118 |
| 0014116 | 2/1978 | Japan | 204/106 |
| 2087431 | 5/1982 | United Kingdom | 204/106 |

*Primary Examiner*—Terryence Chapman

*Attorney, Agent, or Firm*—E. Philip Koltos; Thomas Zack

[57] ABSTRACT

An electrolytic cell is provided for a process which combines at compatible cell geometries and current densities, the electrowinning of a metallic element from an electrolyte with an anodic, electrochemical reaction using a cationic permselective membrane between half-cells to keep the reactions separate. The cell is operated by introducing a metal salt into a catholytic compartment, introducing a compatible electrochemical solution into an anolytic compartment, wherein both of said salt and said electrochemical solution are in an electrolysis cell having a cathode electrode and an anode electrode, and applying an electromotive force across said electrodes whereby an oxidation electrochemical reaction occurs at the anode while the metal of said metal salt is deposited at said cathode.

11 Claims, 2 Drawing Figures

ELECTROLYTIC CELL AND METHODS COMBINING ELECTROWINNING AND ELECTROCHEMICAL REACTIONS EMPLOYING A MEMBRANE OR DIAPHRAGM

TECHNICAL FIELD

This invention relates to a combination anodic electrochemical reaction and cathodic electrowinning reaction which thereby significantly decreases or eliminates the wasteful half-cell reactions associated with electrolysis, and more particularly relates to the electrowinning of metals such as zinc, copper, manganese, cadmium, nickel, cobalt, and chromium, by a combined electrowinning and electrochemical procedure using an electrolytic cell containing a membrane or diaphragm.

BACKGROUND OF THE INVENTION

Electrowinning from aqueous solutions using insoluble anodes is a well-established process for recovery of metals such as zinc, copper, nickel, cobalt, cadmium, manganese and others. The metal is electrodeposited at the cathode from a solution of one of its salts, most commonly a sulfate. Water is decomposed at the anode, which is usually made of lead or a lead alloy, oxygen is evolved and acid (hydrogen ions) is formed. The electrowinning reactions may be described generally by the following (wherein M represents any of the metals mentioned above):

Cathode: $M^{++} + 2e \longrightarrow M$

Anode: $H_2O \longrightarrow \frac{1}{2} O_2 + 2H^+ + 2e$

Overall Reaction: $M^{++} + H_2O \longrightarrow \frac{1}{2} O_2 + 2H^+ + M$

For a sulfate solution, the overall reaction can be written:

$$MSO_4 + H_2O \rightarrow \tfrac{1}{2}O_2 + H_2SO_4 + M$$

The oxidation reaction at the anode is a "waste" reaction because no useful byproduct is produced.

The minimum electrical energy consumption for the electrolytic process is proportional to the reversible electromotive force (emf). The actual energy used corresponds to the operating cell voltage which is the sum of the reversible emf plus irreversible potential differences, namely the ohmic drops, and the anodic and cathodic overpotentials. The actual energy use is inversely proportional to the electrochemical current efficiency. In a typical modern plant, the average current efficiency is 90% and the energy consumption is 1.4 kWh/lb for Zn.

A large amount of the waste of this electrolysis energy is associated with the oxygen evolution reaction involved in water oxidation which takes place at the anode. Accordingly, the substitution of an anodic electrochemical reaction for this wasteful water oxidation reaction would result in significant energy savings. Thus a useful oxidation reaction which can be operated in the same electrochemical cell as one where metal electrowinning is occurring would be of tremendous benefit.

Prior art anodic substitution processes of water oxidation either involve tangential reactions associated with the processes which offset the energy savings claimed, involve processes which are not sufficiently understood to know where the savings may be, or involve the electrowinning from electrolytes other than sulfate which in turn have energy consumption problems associated with them. In addition, the prior art has given attention to lower voltage reactions rather than looking into increased efficiency by using side-by-side reactions, neither of which individually is lower in voltage than commercial half-cell reactions, but which together result in increased voltage drop and high energy savings.

For example, U.S. Pat. No. 4,431,496 to Remick discloses a process for electrolytic recovery of zinc wherein metallic zinc is deposited at the cathode while the anode is depolarized through oxidation of iodide ions to iodine, avoiding oxygen evolution at the anode. The iodide ions are chemically regenerated by extracellular oxidation of sulfur dioxide with water to produce iodide ions and hydrogen ions for recycle to the anode compartment:

$$I_2 + 2H_2O + SO_2 \rightarrow 2I^- + H_2SO_4 + 2H^+$$

The overall electrochemical plus chemical reaction is:

$$ZnSO_4 + 2H_2O + SO_2 \rightarrow Zn + 2H_2SO_4$$

Although the anodic reaction for $I_2$ oxidation to $I_2$ is thermodynamically 0.7 volts less than the corresponding oxygen evolution reaction, much of the energy savings is offset in the energy cost for separating and concentrating the excess sulfuric acid produced in the anolyte. This occurs since twice as much acid is produced as metal in the overall reaction and half the acid must be removed to maintain a constant acid level. Thus, although there is a useful oxidation reaction, energy savings are offset in recovering the products.

U.S. Pat. No. 4,204,922 to Fraser et al teaches a process for simultaneous electrodissolution and electrowinning of metals from a cell comprising an anode and a cathode separated by one or more ion permeable membranes, the membrane being impermeable to the particulate solids in the suspension separating the anode and cathode compartments. The recovery of metals is accomplished from sulphide minerals rather than sulfate electrolytes. The problems associated with elimination of sulphide ore waste products result in much greater inefficiencies. In addition, since there is no hydrogen evolved in this reaction, no current can be carried with these ions resulting in a waste of energy efficiency.

Additional studies report the electrowinning of metals from chloride rather than sulfate solutions. These processes, however, also require the use of a depolarizing anode. In addition, metal which has been deposited from chloride solutions has been found to be needle-like and non-consolidated and to require modified handling procedures.

U.S. Pat. No. 4,268,363 to Coughlin discloses the electrochemical gasification of carbonaceous materials by anodic oxidation which produces oxides of carbon at the anode and hydrogen or metallic elements at the cathode. U.S. Pat. No. 4,405,420 to Vaughan teaches the same reaction catalyzed by an iron catalyst. In both patents the substitution of the reaction $$C_{(s)} + 2H_2O \rightarrow CO_2(g) + 4H^+ + 4e^- \quad E^o = 0.21 \text{ volt}$$

for the reaction $$2H_2O \rightarrow O_2(g) + 4H^+ + 4e^- \quad E^o = 1.23 \text{ volt}$$

results in a cell volt reduction of about one volt.

U.S. Pat. No. 4,279,711 to Vining et al teaches a similar reaction:

$$CH_3OH_{(aq)} + H_2O \rightarrow CO_2 + 6H^+ + 6e^- \quad E^o = 0.043 \text{ volt.}$$

While these reactions are promising because of the low oxidation potential involved in all three reactions, practical applicability of these processes depend on achieving higher current densities, a more efficient consumption of carbon values in coal (for coal slurry reactions) and a more complete understanding of the effect of ash content in coal on the electrowinning kinetics and deposit morphology. No cell design in the prior art permits the full-scale commercial utilization of such a process.

Other studies have taught the simultaneous oxidation and reduction of metal ions in solution (e.g., the oxidation of $Mn^{2+}$ and $MnO_2$ and $Zn^{2+}$ and Zn). In these studies, however, individual half-cells were not divided by a membrane or other separation device, and temperatures of 40°-50° C. above that necessary for efficient metal deposition were required which represented an additional cost factor offsetting savings.

While the prior art methods have taught ways of substituting anodic reactions other than water oxidation in the electrowinning of metals to reduce energy consumption, they have not successfully and economically taught a method where the anodic reaction is an electrochemical non-depolarizing reaction using an electrolyte where the evolved hydrogen is used to carry current through a permselective membrane wherein the membrane both permits the hydrogen ions to pass but also separates the anolyte and catholyte, and where the membrane further permits separate electrochemical and electrowinning reactions to occur at current densities compatible with an economical electrolytic cell. No prior art method has taught an anodic electrochemical reaction involving the oxidation of sodium chlorate to sodium perchlorate, although it is to be understood that the invention is not limited to this reaction and depends only on the compatibility of an electrowinning and electrochemical reaction, given constraints of cell geometry and current densities. Finally, no prior art has taught the use of two half-cell reactions which are combined within a functional cell geometry for efficiency and whose voltage together is lower than the combined individual voltages of each of these commercial half-cell reactions.

SUMMARY OF THE INVENTION

It is therefore an object of this invention to provide a method for electrowinning of metals using an anodic reaction which differs from water oxidation, does not depend on anodic depolarization and which can occur at compatible current densities for the two reactions.

It is a further object of this invention to provide a method for the electrowinning of metals where the anodic reaction involves sulfate oxidation.

A still further object of this invention is to provide an electrolytic cell which is capable of combining electrowinning and electrochemical reactions and which employs a membrane or diaphragm to separate an anodic electrochemical reaction from cathodic electrowinning.

It is an even further object of the invention to efficiently combine two half-cell reactions so that their voltage together is lower than the combined individual voltages of each of the commercial half-cell reactions.

Other objects and advantages of the invention will become apparent as the description thereof proceeds.

In satisfaction of the foregoing objects and advantages, the present invention provides a process for combining at compatible cell geometries and current densities, the electrowinning of a metallic element from an electrolyte with an anodic, electrochemical reaction using a cationic permselective membrane between half-cells to keep the reactions separate and comprising the steps of:

(a) introducing a metal salt into a catholytic compartment and introducing a compatible electrochemical solution into an anolytic compartment such that both said salt and said electrochemical solution are in an electrolysis cell having a cathode electrode and an anode electrode; and (b) applying an electromotive force across said electrodes whereby an oxidation electrochemical reaction occurs at the anode while the metal of said metal salt is deposited at said cathode.

In a further embodiment, there is provided by the invention an electrolytic cell divided into catholytic and anolytic compartments and separated by a cationic permselective membrane, and which has a cathode electrode in the catholytic compartment and an anode electrode in the anolytic compartment, a metal salt being contained in the catholytic compartment and a compatible electrochemical solution being contained in the anolytic compartment, whereby, when an electromotive force is applied across said electrodes, an oxidation-electrochemical reaction occurs at the anode while the metal of said metal salt is deposited at said cathode.

The method and cell of this invention have application to many different processes, particularly the electrowinning of zinc, copper or any of a number of other metals, combined with electrochemical processes. These reactions are accomplished by placing a cationic permselective membrane between the anode and cathode of a membrane electrowinning-electrochemical cell, placing metal salt in the cathode compartment, placing a chlorate in the anode compartment and introducing a power supply between the electrodes to serve as an energy source.

BRIEF DESCRIPTION OF THE DRAWINGS

Reference is now made to the drawings accompanying the application wherein.

DETAILED DESCRIPTION OF THE INVENTION

The present invention relates to methods for electrowinning of metals using a combination electrochemical-electrowinning cell. In this concept, an anodic non-depolarizing reaction is employed which differs from conventional anodic water oxidation reactions. The combined reaction operates at a lower voltage than the individual reactions involved. The electrolytic cell used in the present invention combines the electrowinning and electrochemical reactions, and makes use of a membrane or diaphragm to separate the anolyte from the catholyte in the cell.

The concept of this invention can be applied to any electrowinning cell for a more efficient utilization of the direct current power. Preferably, the electrowinning cell is a sulfate electrowinning cell, although equivalent materials may be used. According to this invention, it has been discovered that by substitution of a commercial anodic electrochemical reaction to replace the conventional water oxidation reaction, a significant decrease in loss of electrolysis energy associated with oxygen evolution in present cells can be achieved.

The invention can be applied to the electrowinning of metals such as zinc, copper, manganese, cadmium, nickel, cobalt and chromium. However, the preferred applications are in the electrowinning of zinc and copper.

In the present invention, the operating voltage of the combination cell is substantially less than the total voltage if the cells were operated independently. This corresponds to a significantly lower electrolysis energy to achieve equivalent production of electrowon and electrochemical materials. The electrolysis conditions in the cell, including temperature, current density and electrode material in the anolyte and catholyte of the combination cells, are generally similar to those of respective independently operated cells except for acidity of the anolyte.

As pointed out, the invention operates using two half cell reactions in the same electrolytic cell, but separated by a permselective membrane, such as that used in electrodialysis cells. A cationic membrane enables the highly mobile hydrogen ions to carry the current through the membrane with a relatively small contribution to the cell voltage. When the current through the membrane is carried by the hydrogen ion produced at the anode, the desired sodium or equivalent salt of the oxidized species is effectively retained in the anolyte for subsequent recovery and the acidity of the catholyte correspondingly is increased. The catholyte of increased acidity may subsequently be used in a leaching step, or in a post solvent extraction acid stripping stage to replenish the metal ions removed by electrowinning.

Figure 1:
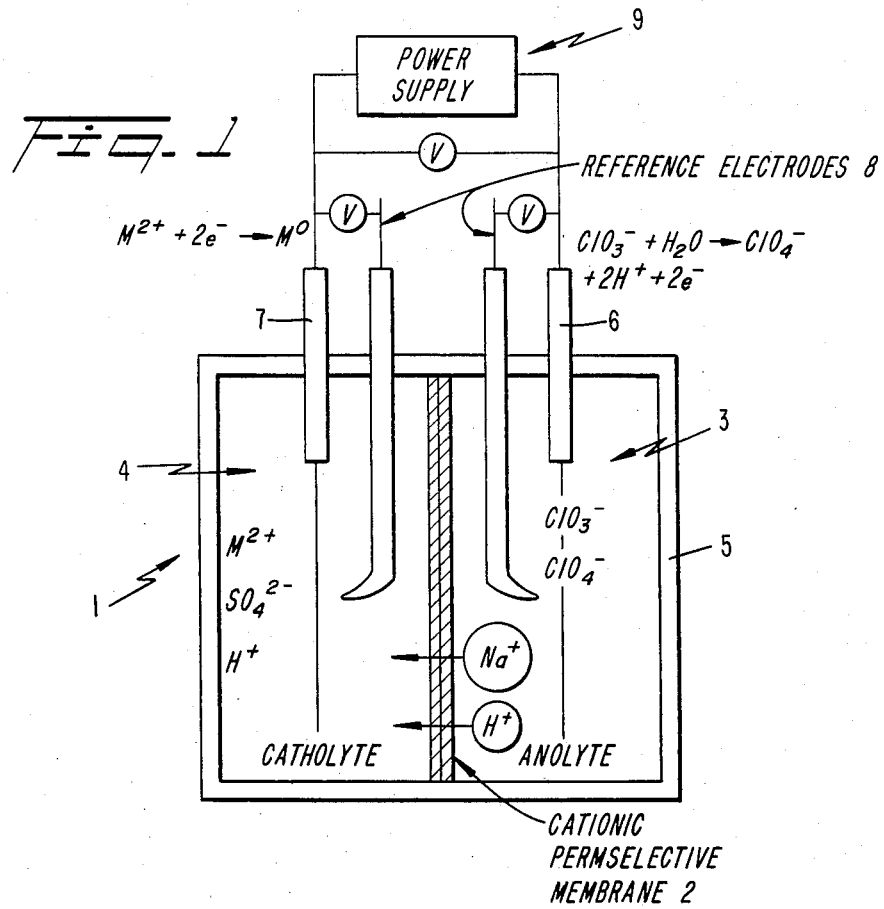
FIG. 1 is a schematic drawing of the electrowinning-electrochemical cell of the invention.

In FIG. 1, there is exemplified an electrowinning-electrochemical cell for use in the invention. In FIG. 1, it will be seen that cell 1 is provided with cationic permselective membrane 2 and includes anolyte 3 and catholyte 4 within the housing 5. Anode 6 is shown in the anolyte compartment and cathode 7 is shown in the catholyte compartment. Reference electrodes 8 are provided for each compartment. Power supply 9 provides the source of energy for the cell. In operation, current densities of from 4 up to 15 $A/dm^2$ may be used.

As indicated above, electrolysis conditions for each of the half cells are similar to those used in independent commercial cells, with the exception that the acid strength of the anolyte will be significantly higher. This is necessary to permit the hydrogen ions to carry a major portion of the current through the membrane. For example, when the anolyte is 2 molar in concentration and the molar ratio of sodium ion to hydrogen ion is about 3:1, up to 88% of the current will be carried by the hydrogen ions. A typical acid concentration in a cell such as a perchlorate cell is about $10^{-5}$M. In the preferred cell, the anode is platinum and the cathode is aluminum. However, it will be understood by those skilled in the art that equivalent materials may be used.

In the cell, the current density in $A/dm^2$ for Zn will range from about 4.0 to 10.0 $A/dm^2$ and about 3.0–6.0 for Cu for the electrowinning compartment and about 10–15 for the $NaClO_4$ compartment. The current efficiency in the electrowinning compartment will range from a 94–98% and 90–93% in the $NaClO_4$ compartment. Temperatures in the cell will range from about 30°–60° C.

The anolyte is preferably acid rather than neutral as in commercial cells. About 2M in acidity is preferred. The acidic concentrations of the catholyte may range from about 0.50M to 2.5M whereas the concentrations of the anolyte may range from about 1.0M to 5.0M.

The membrane used in this cell is typical of cationic membranes used in electrodialysis cells. In the cell of this invention, electrolysis current is conducted through this membrane by means of hydrogen ions and sodium ions which migrate from the anolyte to the catholyte. Since hydrogen ion is produced at the anode during electrolysis, an equilibrium is established between the concentrations of hydrogen ion and sodium ion in the anolyte, and the percentage of the current transported through the membrane by these ions. As a result of the ion selective characterisitcs of the membrane and the equilibrium, the acidity of the catholyte will be markedly increased. This will permit processing and recovery of the anolyte, and subsequent use of the catholyte in a leaching or acid stripping step to replenish metal ions removed by electrowinning.

The cell of the invention may be operated for production of various metals and the electrolytes to be used will depend on the metal to be produced. For example: Zinc-sulfate media; Copper-Sulfate or chloride electrolytes; Nickel-Sulfate media; and Lead-Fluosilicic acid electrolyte.

The present invention is particularly suitable for the electrowinning of zinc and copper from sulfate solutions and perchlorate production from alkali metal chlorate solutions. In this system, the catholyte will contain zinc sulfate or copper sulfate, and the anolyte will comprise an alkali metal chlorate and perchlorate, preferably sodium chlorate, ($NaClO_3$) and sodium perchlorate, ($NaClO_4$). In the anolyte solution, with cells using solutions of this type, the sodium chlorate will be oxidized to sodium perchlorate, with hydrogen ions and sodium ions passing through the permselective membrane, as shown in FIG. 1. In the catholyte compartment of the cell, the elemental zinc or copper is deposited on the cathode. The reactions involved are shown in FIG. 1.

The following examples are presented to illustrate the invention, but it is not to be considered as limited thereto. In the examples and throughout the specification, parts are by weight unless otherwise indicated.

EXAMPLE 1

FIG. 1 shows the rectangular experimental cell used in this study. The 180-ml-capacity cell was made of polyacrylic plastic. The 0.38-mm-thick cationic permselective membrane 2 employed to separate the cell into two equally sized anolyte and catholyte sections 3 and 4 was a commercially available heterogeneous type consisting of a sulfonated styrene exchange resin on an inert polyolefin fabric. Resistivity of the membrane was 6 ohm-$cm^2$ in 1.0N NaCl solution. According to the experiments, a 0.27-$dm^2$ area of the membrane 2 was exposed to the electrolytic current. The cathode material 7 consisted of either an aluminum sheet for zinc (Zn) electrowinning or a stainless steel sheet for copper (Cu).

The exposed cathode area was kept constant at 0.2 $dm^2$. The area of the smooth platinum anode 6 was adjusted from 0.03 to 0.2 $dm^2$ to maintain the anode current density between 10 and 20 $A/dm^2$ at corresponding cathode current densities of 3 to 10 $A/dm^2$. The two electrodes 6 and 7 were placed vertically in the center of each half-cell, spaced 50 mm apart, and positioned parallel to the membrane 2. Potentials in each half-cell were measured versus an Ag-AgCl (3MKCl) microelectrode fitted into a luggin capillary that was rotated between the wall of the membrane 2 and the surface of the electrodes 6 or 7. Potential values are reported against the standard hydrogen electrode, assuming it to be −0.210 v to the Ag-AgCl reference. A constant DC power supply controlled current to the cell. Individual voltages and total coulombs were recorded on a strip chart recorder and an ampere-hour meter, respectively. Temperature of the anolyte and catholyte was controlled by partial immersion of the cell in a constant-temperature water bath.

According to the specific embodiments of the invention, the following solutions were used: The catholyte for Zn electrowinning was 2.1M (137 g/L) $Zn^{2+}$ as $ZnSO_4$ and 1M (98 g/L) $H_2SO_4$, while that for Cu electrowinning was 1M $Cu^{2+}$ as $CuSO_4$ and 1M $H_2SO_4$. The anolyte solution consisted of 4.7M $NaClO_3$ and 1.6M $NaClO_4$. In select tests, the $NaClO_4$ was replaced by perchloric acid ($HClO_4$). Zinc electrowinning and copper electrowinning are the two embodiments discussed herein but it is to be understood that any of the metals discussed previously may be used in this process. It is also to be understood that the anolytic solution may vary depending on which electrochemical reaction is occurring and this is limited only by cell geometry and current densities as can be easily ascertained by one skilled in the art.

Samples of this anolyte and catholyte were taken for analysis before, during and after the electrolysis experiments to find anode current efficiencies and to evaluate the effectiveness of the membrane. Standard volumetric, geometric, spectrophotometric, and potentiometric analytical techniques were used to determine the concentration of $Cu^{2+}$, $Zn^{2+}$, $ClO_3^-$, $ClO_4^-$, $SO_4^{2-}$ and $Na^+$ in solution. Zn and Cu electrowinning efficiencies were calculated from the weight of the cathode deposit.

The data acquired from operation of the cell provided information on (a) the condition required for each half-cell to function simultaneously at compatible current densities and temperatures, (b) electrolysis energy requirements and (c) the efficiency of the permselective membrane to provide physical separation and electrical connection of the anolyte and catholyte. The results of the experiments are broken down into the effects on current density and voltage.

Figure 2:
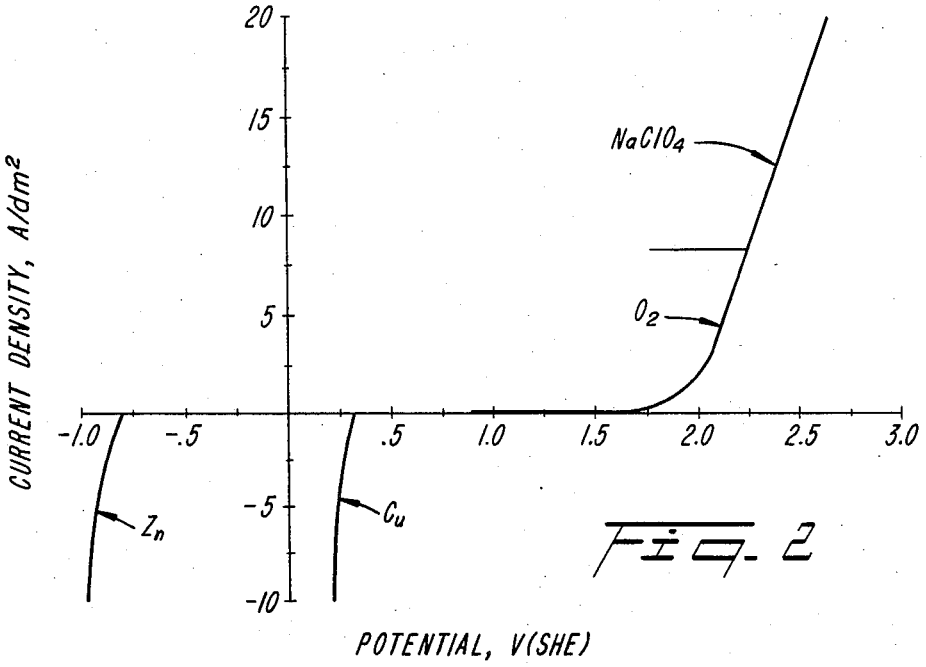
FIG. 2 is a typical polarization curve for zinc and copper electrowinning and $NaClO_4$ production.

FIG. 2 shows typical polarization curves for the reactions studied in this cell. In the anodic oxidation of $NaClO_3$ to $NaClO_4$, the reaction kinetics increasingly favor the electrolysis of water at current densities below 10 $A/dm^2$. The maximum current density for zinc and copper electrowinning is usually less than that of $NaClO_3$ to $NaClO_4$ reaction. Thus, to operate each half-cell at ideal current densities, the area of the anode was reduced relative to the area of the cathode. To minimize the differences in electrode areas, the current densities were matched as closely as possible, thus preventing impractical cell geometries. It was critical to the results of this invention that both half-cell reactions could occur within the same cell geometry.

As can be noted in Table I following where this experiment is compared with commercial cells, it was observed during the experiments that the combination half-cells are compatible and can be operated efficiently using electrolyte temperatures and electrode current densities similar to those in independent commercial cells. Zn and $NaClO_4$ were each produced at greater than 90 percent current efficiency when the cell was operated at 50° C. and the cathode and anode current densities were controlled at 4 to 10 $A/dm^2$ and 10 to 20 $A/dm^2$ and 10 to 20 $A/dm^2$ respectively. Because satisfactory Zn deposits were obtained at the highest current density of 10 $A/dm^2$, the possibility exists of combining Zn and $NaClO_4$ half-cells at equal densities of 10 $A/dm^2$. Operation of the combination cell at cathode and anode current densities of 6.5 and 15 $A/dm^2$ repeatedly yielded favorable results and appeared to be the most practical combination.

TABLE I

Operating Parameter and Efficiency Comparisons for Zn—$NaClO_4$ and Commercial Cells

| Electrolysis Cell | Temperature, °C. | Current Density, $A/dm^2$ Electro-Winning | Current Density, $A/dm^2$ $NaClO_4$ Production | Current Efficiency, pct Electro-Winning | Current Efficiency, pct $NaClO_4$ Production |
|---|---|---|---|---|---|
| Commercial Zn electrowinning* | 35–40 | 4–10 | NAp | 85–93 | NAp |
| Commercial $NaClO_4$ production** | 30–60 | NAp | 15–45 | NAp | 80–95 |
| Combined Zn—$NaClO_4$ electrolysis | 50 | 4.5–10 | 10–20 | 92–97 | 90–92 |

*As described by Cotteral et al, J. Electrochem. Soc. V. 103(3) (1956) pp. 166–170, and Mantell, "Electrochemical Engineering", Chemical Engineering Series, McGraw-Hill Book Co., Inc. New York, N.Y. 1960

**Castle Technology Corporation, "Survey of Electrochemical Production of Inorganic Compounds," Argonne Nat. Lab. (Argonne, Ill.), prepared for U.S. Dept. of Energy under Contract No. W-31-109-38-5054, ANL/O-EPM-80-3, available from NTIS, Springfield, Va.

EXAMPLE 2

In another embodiment involving copper electrowinning, compatibility of current densities was more difficult to achieve because the practical current density for Cu electrowinning under normal mass transport conditions does not exceed about 3 $A/dm^2$. These electrowinning experiments were conducted using the conditions and with the results shown in Table II.

TABLE II

| Electrolysis Cell | Temperature, °C. | Current Density, A/dm² Electro-Winning | Current Density, A/dm² $NaClO_4$ Production | Current Efficiency, pct Electro-Winning | Current Efficiency, pct $NaClO_4$ Production |
|---|---|---|---|---|---|
| Commercial Cu electrowinning* | 35–55 | 1.5–3.2 | NAp | 98–99 | NAp |
| Commercial $NaClO_4$ production** | 30–60 | NAp | 15–45 | NAp | 80–95 |
| Combined Cu—$NaClO_4$ electrolysis | 50 | 3.0–6.5 | 10–15 | 94–98 | 90–93 |

*C. L. Mantell, "Electrochemical Engineering", Chemical Engineering Series, McGraw-Hill Book Co., Inc. New York, N.Y. 1960; and J. C. Yannopoulos et al, "AIME International Symposium on Copper Extraction and Refining-Extractive Metallurgy of Copper," Port City Press, Baltimore, Md., v. 2 (1976).
**Castle Technology Corporation, "Survey of Electrochemical Production of Inorganic Compounds," Argonne Nat. Lab. (Argonne, Ill.), prepared for U.S. Dept. of Energy under Contract No. W-31-109-38-5054, ANL/O-EPM-80-3, available from NTIS, Springfield, Va.

EXAMPLE 3

A. In this experiment involving zinc electrowinning, cathode and anode current densities of 6.5 and 15 A/dm² respectively were used, and compared with separate commercial cells for Zn and $NaClO_4$. The cell voltage for the combination cell Zn-$NaClO_4$ was 4.5 volts compared to 9.9 volts for the sum of the cell voltages of the two Zn and $NaClO_4$ cells when operated separately and with water electrolysis as one of the cell reactions. The cationic membrane contributed only 0.18 volts to the cell voltage of the combination cell. Electrolysis energy consumed by each half-cell in the combination cell was determined from the measured half-cell voltage (SHE) plus 50 percent of the membrane voltage and compared to the voltage of the independently operated cell. On that basis, the electrolysis energy was decreased from 3.43 to 1.14 kWh/kg for zinc electrowinning and from 2.97 to 1.32 kWh/kg for $NaClO_4$ production.

A 55 percent decrease in cell voltage was achieved when Zn electrowinning is combined with the electrochemical product of $NaClO_4$.

B. In the embodiment of the cell using copper electrowinning, a 64 percent decrease in cell voltage in the combination cell was achieved when cathode and anode current densities of 3 and 15 A/dm², respectively, are used. The combination voltage was 2.95 volts versus 8.23 volts in the combined individual cells for Cu and $NaClO_4$. The membrane contributed 0.21 volts. Electrolysis energy was decreased from 2.97 to 1.32 kWh/kg for $NaClO_4$ production.

EXAMPLE 4

In this example, investigations were made regarding the extent of diffusion through the membrane by the other ions. Table III shows the extent of ionic diffusion for several ions during 2.3 A.h of electrolysis. Less than 1 percent of the initial concentrations of $Zn^{2+}$, $Cu^{2+}$, $ClO_3^-$, and $ClO_4^-$ diffused through the membrane, while about 3.7 percent of the $SO_4^{2-}$ diffused.

TABLE III

| Ion | Anolyte Concentration, g/l Initial | Anolyte Concentration, g/l Final | Catholyte Concentration, g/L Initial | Catholyte Concentration, g/L Final | Diffusion, pct of Initial |
|---|---|---|---|---|---|
| $Cu^{2+}$ | 0 | 0.3 | 60 | 30 | 0.50 |
| $Zn^{2+}$ | 0 | 0.8 | 140 | 110 | 0.57 |
| $ClO_3^-$ | 392 | 350 | 0 | 1.7 | 0.43 |

TABLE III-continued

| Ion | Anolyte Concentration, g/l Initial | Anolyte Concentration, g/l Final | Catholyte Concentration, g/L Initial | Catholyte Concentration, g/L Final | Diffusion, pct of Initial |
|---|---|---|---|---|---|
| $ClO_4^-$ | 167 | 209 | 0 | 1.6 | 1.0 |
| $SO_4^{2-}$ | 0 | 11.0 | 300 | 289 | 3.7 |

While the present invention has been described with reference to specific embodiments, this application is intended to cover those various changes and substitutions which may be made by those skilled in the art without departing from the spirit and scope of the appended claims.

What is claimed is:

1. A process for combining at compatible cell geometries and current densities the electrowinning of a free metal element on a cathode in a catholytic electrolyte in a cell in which there is an anode with an anolytic electrolyte with a cationic permselective membrane between the catholytic electrolyte and anolytic electrolyte thereby forming a catholytic half-cell compartment and an anolytic half-cell compartment, where the voltage for the combined catholytic half-cell and anolytic half-cell is reduced greater than 50% as compared to the sum of the cell voltages of two independently operating nonmembrane cells using an electrolyte selected from the catholytic electrolyte or the anolytic electrolyte and with water electrolysis at the anode, comprising:
   (a) introducing a metal sulfate salt into said catholytic electrolyte in said half-cell catholytic compartment
   (b) introducing an alkali metal chlorate and an alkali metal perchlorate into said anolytic electrolyte in said half-cell anolytic compartment; and
   (c) applying an electromotive force across said cathode and anode whereby an oxidation electrochemical reaction occurs at the anode to produce a perchlorate while the free metal element of said metal salt is deposited at said cathode.

2. The process as defined by claim 1 where said metal of said metal salt is selected from the group consisting of zinc, copper, manganese, cadmium, nickel, cobalt, and chromium.

3. The process as defined by claim 2 wherein the metal of said metal salt is zinc.

4. The process as defined by claim 1 where said anolytic electrolyte is an anolyte which can be oxidized within said electrochemical cell at compatible current densities and cell geometry with the electrowinning reaction.

5. The process as defined by claim 4 wherein the catholytic electrolyte is about 2.1M (137 g/L) $Zn^{2+}$ as $ZnSo_4$ and 1M (98 g/L) $H_2SO_4$.

6. The process as defined by claim 2 wherein the metal of said metal salt is copper.

7. The process as defined by claim 6 wherein the catholytic electrolyte is about 1M $Cu^{2+}$ as $CuSO_4$ and about 1M $H_2SO_4$.

8. The process as defined by claim 1 wherein the anolytic electrolyte comprises about 4.7M $NaClO_3$ and 1.6M $NaClO_4$.

9. The process as defined by claim 8 wherein the anolyte solution comprises about 4.7M $NaClO_3$ and 1.6M $HClO_4$.

10. The cell of claim 1 wherein the membrane is about 0.38 mm thick and comprises a heterogeneous sulfonated styrene resin on an inert polyolefin fabric.

11. The cell of claim 10 wherein the membrane which has a resisitivity of about 6 ohm-$cm^2$ in 1.0N NaCl solution.

* * * * *